United States Patent [19]

Shichida

[11] Patent Number: 5,022,872

[45] Date of Patent: Jun. 11, 1991

[54] JACK

[75] Inventor: Akihito Shichida, Osaka, Japan

[73] Assignee: Hosiden Electronics Co., Ltd., Osaka, Japan

[21] Appl. No.: 544,376

[22] Filed: Jun. 27, 1990

[30] Foreign Application Priority Data

Jul. 12, 1989 [JP] Japan ..... 1-82678[U]

[51] Int. Cl.[5] ..... H01R 13/00

[52] U.S. Cl. ..... 439/668

[58] Field of Search ..... 439/217, 223, 668, 669

[56] References Cited

U.S. PATENT DOCUMENTS

| | | | |
|---|---|---|---|
| 1,696,865 | 12/1928 | Schellenger | 439/668 |
| 3,192,498 | 6/1965 | Ruehlemann | 439/223 |
| 3,418,438 | 12/1968 | Barrett | 439/668 |

*Primary Examiner*—Joseph H. McGlynn

*Attorney, Agent, or Firm*—Pollack, VandeSande and Priddy

[57] ABSTRACT

In a jack which has in its body a tip contact piece for engagement with a tip electrode of a plug when the plug is inserted into the jack body through its plug insertion hole, the tip contact piece is a U-shaped metal piece whose two legs form first and second contact pieces for gripping therebetween the tip electrode of the plug. The first contact piece is longer than the second one and its forward end is inwardly convexed to form an engaging protrusion for engagement with the neck of the tip electrode. The engaging protrusion extends into the plug insertion hole to a depth of about 20% of its inner diameter. When the plug is inserted into the jack body, a forward contact portion of the second contact piece resiliently contacts the crest of the tip electrode after the latter has moved past the engaging protrusion of the first contact piece.

7 Claims, 3 Drawing Sheets

JACK

BACKGROUND OF THE INVENTION

The present invention relates to a jack which has a tip contact piece for engagement with a tip electrode of a plug upon its insertion into the jack body.

FIG. 1 shows a conventional jack of this kind. When a plug 12 is not inserted, a tip contact piece 11 assumes such a position as indicated by the broken lines in FIG. 1A, whereas when the plug 12 is inserted, the tip contact piece 11 is thrust aside or displaced by a spherically-headed tip electrode 13 of the plug 12 as shown in FIG. 1B, and as the plug 12 is further pushed into the jack, an engaging protrusion 15 of the tip contact piece 11 slides down the spherical surface of a radial protrusion 14 of the tip electrode 13 into engagement with its neck 16 as depicted in FIG. 1A. As a result of this, the plug 12 is anchored to the jack and the tip end portion 17 of the tip contact piece 11 resiliently contacts the radial protrusion 14 of the tip electrode 13, thus establishing electrical connection between the tip contact piece 11 and the tip electrode 13.

To ensure good contact between the tip end portion 17 of the tip contact piece 11 and the radial protrusion 14 of the tip electrode 13, the prior art jack is designed so that the tip contact piece 11 extends close to or across the center axis X of the jack as indicated by the broken lines in FIG. 1A while not in use but is displaced relatively greatly when the plug is inserted in the jack. Accordingly, the amount of displacement D of the tip contact piece 11 is large between its initial position (indicated by the broken lines in FIG. 1A) and its outermost position where the engaging protrusion 15 makes contact with the radial protrusion 14 of the plug 12 as depicted in FIG. 1B. For example, in the case where a tip contact piece 11 of phosphor bronze, 0.4 mm thick, is used for a standard 6.4 mm diameter plug, it is customary in the prior art that the length L of the contact piece 11 is 11 mm and its maximum amount of displacement D is 3 mm or more, and the initial position of the engaging protrusion 15 of the tip contact piece 11 is close to the center axis X of the jack. That is, the engaging protrusion 15 projects into the plug insertion hole to a radial depth of about 50% of its inner diameter. Since the tip contact piece 11 is subjected to substantial displacement, a highly resilient material (phosphor bronze, usually) is used therefor so that the resiliency of the tip contact piece 11 will not be impaired by its displacement, and this inevitably raises the material cost. Moreover, the tip contact piece 11 is formed long with a view to maintain its resiliency, and hence is bulky, and this also increases the material cost.

SUMMARY OF THE INVENTION

It is therefore an object of the present invention to provide a jack which is free from the above-mentioned defects of the prior art.

According to the present invention, the tip contact piece is a U-shaped metal piece, the two legs of which form first and second contact pieces for holding therebetween the tip electrode of the mating plug. The first contact piece is longer than the second one and has its forward end portion curved inward to form a protrusion for engagement with the neck of the tip electrode of the plug. The radial depth of the projection of the engaging protrusion into the plug insertion hole is within 20% of its inner diameter at most. The first contact piece assumes substantially the same position before and after the insertion of the mating plug into the jack. The second contact piece has in its forward portion a contact portion which resiliently receives the radial protrusion of the tip electrode after the latter has moved across the engaging protrusion of the first contact piece.

DESCRIPTION OF THE PREFERRED EMBODIMENT

Figure 2:
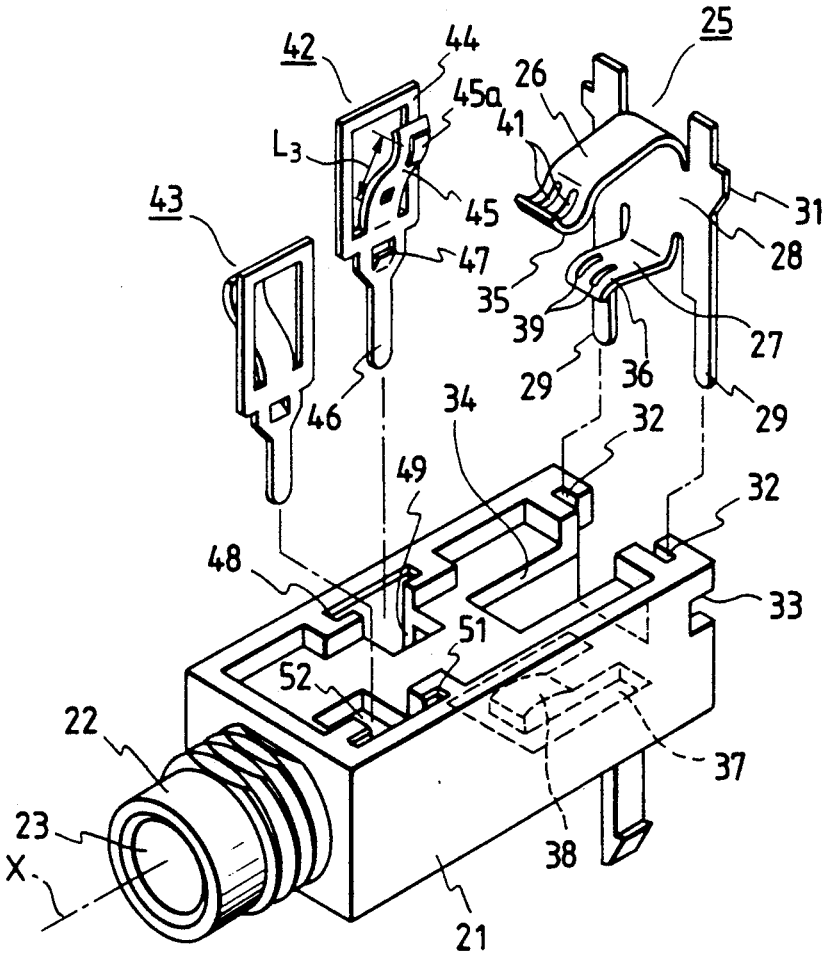
FIG. 2 is an exploded perspective view illustrating an embodiment of the present invention.
Figure 3:
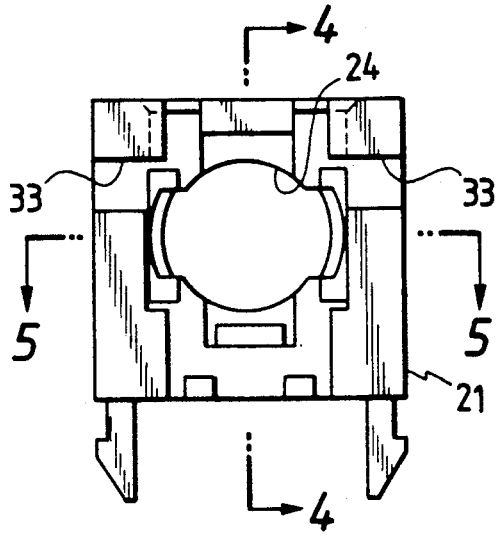
FIG. 3 is a rear view of a jack body 21.
Figure 4:
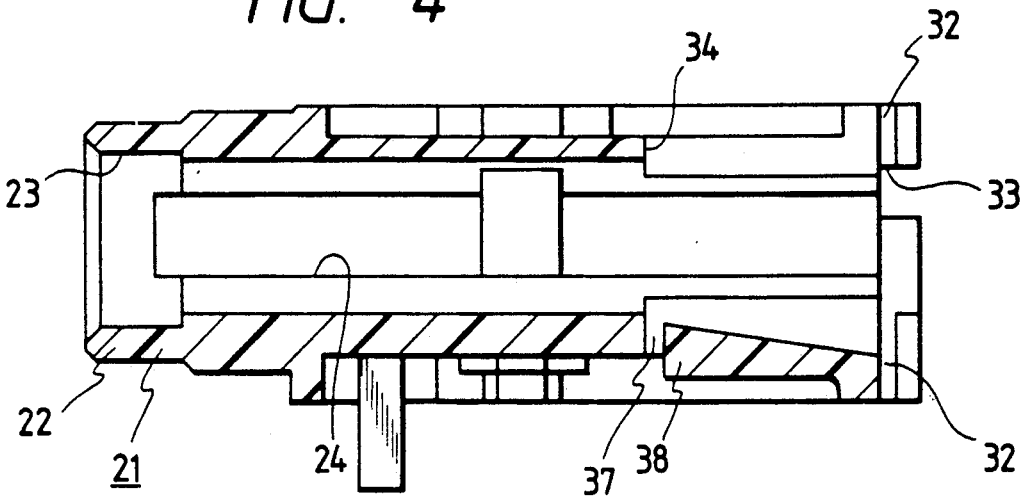
FIG. 4 is a sectional view taken on the line 4—4 in FIG. 3.
Figure 5:
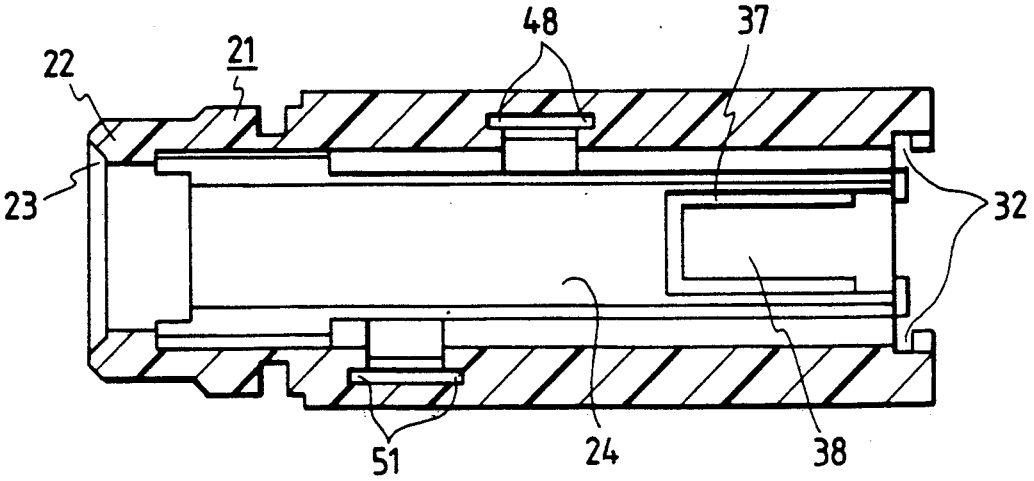
FIG. 5 is a sectional view taken on the line 5—5 in FIG. 3.

FIG. 2 is an exploded view of an embodiment of the present invention. A rectangular parallelepiped body 21 of an insulating material has on its front a sleeve 22 formed integrally therewith, and the sleeve 22 has in its front a front opening 23 through which a plug is inserted into the body 21. The body 21 has a plug insertion hole 24 extending therethrough in communication with the front opening 23 as depicted in FIGS. 3 through 5. The body 21 is produced by molding synthetic resin. A tip contact piece 25 is provided for engagement with the tip electrode of the plug when the plug is inserted into the jack body 21.

As shown in FIG. 2, the tip contact piece 25 is formed by bending a metal plate into a U-shape and its two legs form first and second contact pieces 26 and 27, the piece 26 being longer than the piece 27. The first and second contact pieces 26 and 27 extend forward (i.e. toward the front opening 23) and have their rear ends coupled together at a coupling portion 28. The coupling portion 28 is flanked by a pair of terminals 29 formed integrally therewith and extending downward. The tip contact piece 25 has lugs 31 protruding laterally outwardly from outer edges of both terminals 29 at their upper portion. The body 21 has in its rear end portion a pair of opposed grooves 32 which extend from the top of the body 21 to the underside thereof. The two terminals 29 of the tip contact piece 25 are received in the pair of grooves 32, with the coupling portion 28 closing the rear open end of the body 21. In this case, the lugs 31 of the tip contact piece 25 are engaged with recesses 33 formed across the grooves 32 (see FIG. 3), thus preventing the tip contact piece 25 from coming out of the jack body 21. The lower end portions of the terminals 29 extend past the underside of the body 21.

When assembling the tip contact piece 25 on the body 21, the second contact piece 27 is inserted in the plug insertion hole 24 through a top opening 34 made in the top of the body 21 and the first contact piece 26 is positioned in the top opening 34. The forward end portion of the first contact piece 26 is curved radially inwardly with respect to the center axis X to form an engaging protrusion 35. The inner diameter of the plug insertion hole 24 is slightly larger than the outer diameter of the plug 14, but if they are assumed to be about the same, the radial depth of projection of the engaging protrusion 35 into the plug insertion hole 24 (slightly greater than a maximum displacement $D_1$ shown in FIG. 6A) is approximately 20% of the inner diameter of the hole 24. This radial depth of projection is within about twice the thickness T of the tip contact piece 25. The forward end portion of the second contact piece 27 is also curved radially inwardly with respect to the center axis X to form a contact portion 36, and its maximum displacement $D_2$ (see FIG. 6B) is about the same as the thickness T of the tip contact piece 25.

Figure 6A:
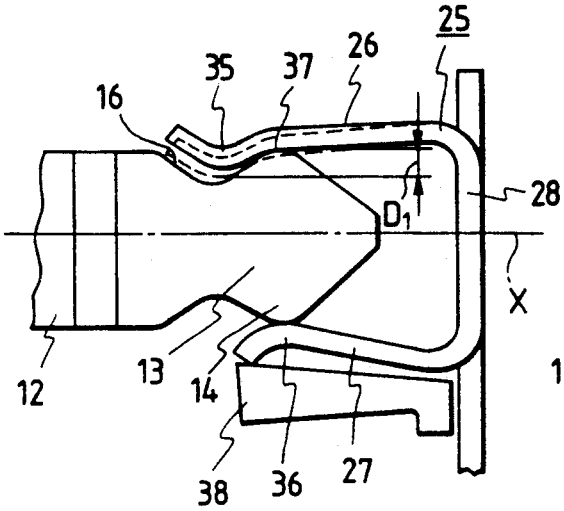
FIG. 6A is a diagram showing the relationship between a tip contact piece 25 of the jack of the present invention and the mating plug being inserted thereinto.
Figure 6B:
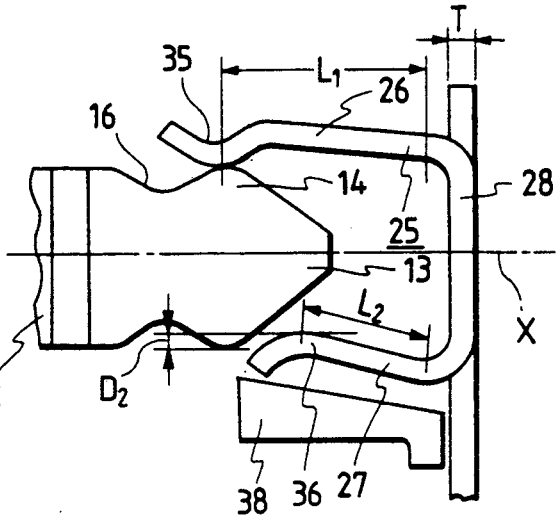
FIG. 6B is a diagram similarly showing the relationship between the tip contact piece 25 and the plug when the latter is inserted into the jack.

For example, in the case of a standard 6.4 mm diameter plug, the outer diameter of the radial protrusion 14 of the tip electrode 13 is 6.0 mm, whereas the thickness T of the tip contact piece 25 of brass is 0.6 mm and the lengths $L_1$ and $L_2$ of the first and second contact pieces 26 and 27 are 6.5 and 5.0 mm, respectively. With no plug being inserted, the engaging protrusion 35 radially protrudes 0.8 mm (the maximum displacement $D_1$) toward the center axix X from the outermost diameter position of the radial protrusion 14 of the plug 12, and this position of the engaging protrusion 35 is about 1.0 mm radially inside the plug insertion hole 24. As shown in FIG. 6A, when the plug 12 is inserted into the body 21, the tip electrode 13 is gripped between the first and second contact pieces 26 and 27, with the engaging protrusion 35 of the first contact piece 26 received in the neck 16 of the tip electrode 13 and the contact portion 36 of the second contact piece 27 resiliently engaging the radial protrusion 14 of the tip electrode 13. On this occasion, the position of the first contact piece 26 is about the same as that before the insertion of the plug (as indicated by the broken lines), and consequently, the first contact piece 26 also makes contact with the radial protrusion 14 of the tip electrode 13 at a point 37 but the contact pressure in this case is low. Further, when the plug is inserted, the contact portion 36 of the second contact piece 27 receives the tip electrode 13 and is displaced after the radial protrusion 14 of the latter passes the underside of the engaging protrusion 35 of the first contact piece 26.

Figure 7:
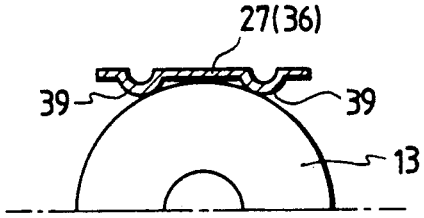
FIG. 7 is a diagram showing the contact of a contact portion 36 with the plug.

In this embodiment, as shown in FIGS. 2 and 5, the body 21 has a resilient piece 38 opposite the second contact piece 27, formed by cutting a U-shaped groove 37 in the bottom of the body 21 and coupled thereto at the rear end. When the second contact piece 27 is displaced by the tip electrode 13 as the plug 12 is inserted as shown in FIG. 6A, the front end of the second contact piece 27 is pressed against the auxiliary contact piece 38 and hence displaces it, thus providing for increased contact pressure of the second contact piece 27 with the tip electrode 13. Moreover, as shown in FIGS. 2 and 7, the contact portion 36 of the second contact piece 27 has a pair of parallel ridges 39 extending in the front-to-back direction so that the contact portion 36 makes three-point contact with the tip electrode to enhance the reliability of contact therebetween. Likewise, a pair of ridges 41 may be provided as well on the engaging protrusion 35 of the first contact piece 26.

In this embodiment, as shown in FIG. 2, a ring contact piece 42 and a grounding contact piece 43 are housed in the body 21 along its side walls but staggered in the direction of insertion of the plug. The ring contact piece 42 has a plate spring contact 45 extending diagonally from one side of a square frame 44 and a terminal 46 extending down from the above-said one side of the frame, and the terminal 46 has a lance 47 set up from its upper portion. The body 21 has a groove 48 extending down from its top along one side wall thereof, and an opening 49 communicating with the groove 48 and the plug insertion hole 24. When the frame 44 is inserted into the groove 48, the plate spring contact 45 passes through the opening 49 and its tip contact portion **45*a* extends into the plug insertion hole 24. Consequently, the plate spring contact 45 extends at right angles to the center axis X of the plug insertion hole 24. The length $L_3$ of the plate spring contact 45 is as short as 6.0 mm and its maximum displacement is around 1 mm. The lance 47 is used to prevent the ring contact piece 42 from coming out of the groove 48. The grounding contact piece 43 has the same construction as the ring contact piece 42 and is inserted into a groove 51 and an opening 52. That is, in this embodiment the ring contact piece 42 and the grounding contact piece 43 are both mounted in the body 21** from above at right angles thereto; this allows ease in automatic assembling of the jack.

When the plug 12 is inserted into the body 21, the engaging protrusion 35 of the first contact piece 26 is engaged with the neck 16 of the tip electrode 13 to prevent the plug 12 from coming off the jack, and the contact portion 36 of the second contact piece 26 resiliently contacts the radial protrusion 14 of the tip electrode 13 to establish electrical engagement between the tip electrode 13 and the tip contact piece 25. A ring electrode and a grounding electrode (not shown) of the plug 12 are brought into resilient contact with the ring contact piece 42 and the grounding contact piece 43, respectively, and hence are electrically connected thereto.

Figure 1A:
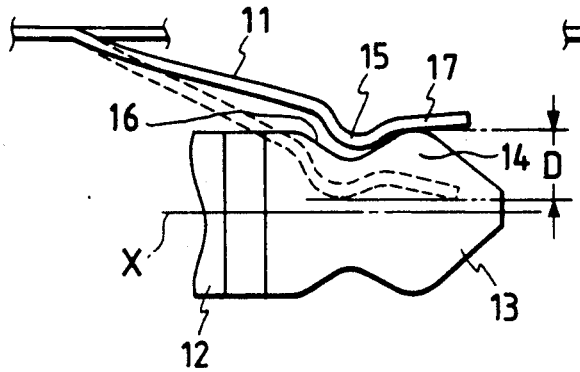
PRIOR ART FIG. 1A
FIGS. 1A and 1B are diagrams showing the relationship between a tip contact piece of a conventional jack and a plug inserted thereinto.
Figure 1B:
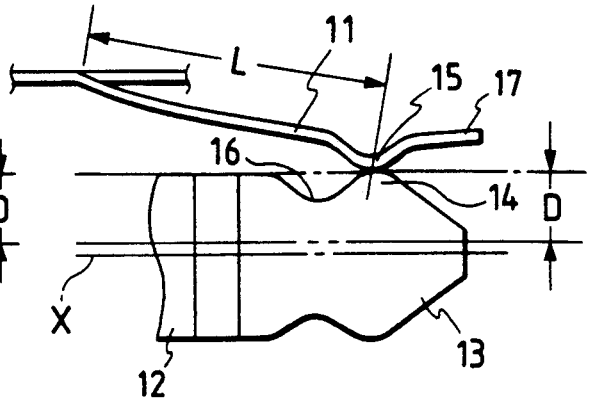

As described previously in respect of FIG. 6A, the initial position (indicated by the broken lines) of the first contact piece 26 before insertion of the plug and its position after insertion of the plug are substantially the same, and the displacement of the engaging protursion 35 by the insertion of the plug reaches the maximum $D_1$ when the crest of the radial protrusion 14 of the tip electrode 13 moves past the engaging protrusion 35. This displacement corresponds to the difference between the distance from the center axis X to the engaging protrusion 35 before insertion of the plug and the height of the crest of the radial protrusion 14. The displacement $D_1$ is smaller than displacement D of the tip contact piece 11 of the conventional jack shown in FIGS. 1A and 1B. The second contact piece 27 needs only to make good contact with the tip electrode 13 and is not engaged with the neck 16 of the tip electrode 13, and hence the displacement $D_2$ of the second contact piece 27 by insertion of the plug is also small. Since the maximum displacement of either of the first and second contact pieces 26 and 27 is small, it is possible to employ, as the material of the tip contact piece 25, brass, stainless steel or the like which is less resilient but less expensive than phosphor bronze and to reduce the lengths $L_1$ and $L_2$ of the first and second contact pieces 26 and 27. Although the amounts of displacement of the first and second contact pieces 26 and 27 are small, the contact between the plug and the jack is reliable because the plug is gripped by and between both contact pieces. The tip contact piece 25 is formed thick so as to obtain a sufficient contact pressure with a small amount of displacement; for instance, about 0.6 mm thick in the case of brass being used. The lengths $L_1$ and $L_2$ of the contact piece 26 and 27 are short and their thicknesses are large, but since the second contact piece 27 is displaced by the tip electrode 13 after the crest of the radial protrusion of the latter has passed the engaging protrusion 35 of the first contact piece 26, that is, after the displacement of the first contact piece 26 has become smaller than the maximum, the force for inserting the plug into the jack is smaller than in the case where the first and second contact pieces 26 and 27 are simultaneously displaced by the tip electrode.

It will be apparent that many modifications and variations may be effected without departing from the scope of the novel concepts of the present invention.

What is claimed is:

1. A jack which has a tip contact piece mounted on a body of insulating material for engagement with a tip electrode of a plug when the plug is inserted into a plug insertion hole in said body, said tip electrode of the plug having a neck and a radial protrusion;

said tip contact piece having a U-shape formed by bending a metal plate, said tip contact piece being disposed at a rear end of said body and having two legs that extend forward in said plug insertion hole, said two legs defining first and second contact pieces for gripping therebetween said tip electrode of said plug when said plug has been inserted into said plug insertion hole;

said first contact piece being longer than said second contact piece, a forward free end portion of said first contact piece being inwardly convexed to form an engaging protrusion that projects into said plug insertion hole for engagement with the neck of said tip electrode when said plug is inserted into said plug insertion hole, the depth of projection of said engaging protrusion into said plug insertion hole being within about 20% of the inner diameter of said plug insertion hole; and said second contact piece having a forward free end portion that includes a contact portion which is disposed rearward of said engaging protrusion and which is positioned to make resilient contact with the radial protrusion of said tip electrode after the radial protrusion of said tip electrode has passed said engaging protrusion of said first contact piece during insertion of said plug into said body.

2. The jack of claim 1, wherein said body has cut therein a U-shaped groove opposite said second contact piece to form an auxiliary resilient piece.

3. The jack of claim 1, wherein said second contact piece has on its forward end portion a pair of parallel ridges extending in the direction of insertion of said plug for contact therewith.

4. The jack of claim 1, wherein said body has in its top near the rear end thereof an opening communicating with said plug insertion hole, and said first contact piece lies in said opening with said engaging protrusion extending into said plug insertion hole by a radial depth substantially corresponding to the thickness of said first contact piece.

5. The jack of claim 1, wherein a ring contact piece and a grounding contact piece are disposed on opposite sides of said plug insertion hole but at different positions relative to the direction of insertion of said plug, and said ring contact piece and said grounding contact piece each have a plate spring contact extending at right angles to the direction of insertion of said plug with their tip end portions extending into said plug insertion hole.

6. The jack of claim 1 or 2, wherein said tip contact piece has a terminal formed integrally therewith at either side of a portion through which said first and second contact pieces are coupled together, said terminals extending at right angles to the direction of insertion of said plug.

7. The plug of claim 6, wherein said body is substantially a rectangular parallelepiped, said body having in its top at the rear end thereof a top opening for passing therethrough said first and second contact pieces to said plug insertion hole and grooves for guiding said terminals of said tip contact piece in parallel to the rear end face of said body.

* * * * *